US008400225B1

(12) United States Patent
Sessions et al.

(10) Patent No.: US 8,400,225 B1
(45) Date of Patent: Mar. 19, 2013

(54) PHOTOCAPACITIVELY TUNABLE ELECTRONIC DEVICE UTILIZING ELECTRICAL RESONATOR WITH SEMICONDUCTOR JUNCTION

(75) Inventors: Walter D. Sessions, King George, VA (US); Kevin A. Boulais, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 91 days.

(21) Appl. No.: 13/136,904

(22) Filed: Aug. 10, 2011

(51) Int. Cl.
*H01J 25/10* (2006.01)

(52) U.S. Cl. ..... 331/83; 331/177 R; 333/231; 315/5.46; 315/5.53

(58) Field of Classification Search ..... 331/79, 331/81, 83, 96, 97; 333/227, 228, 231; 315/5.46, 315/5.53, 39.55
See application file for complete search history.

(56) References Cited

U.S. PATENT DOCUMENTS 3,484,861 A * 12/1969 Dehn ..... 315/5.16
3,882,419 A * 5/1975 Swartz et al. ..... 331/96
6,801,104 B2 * 10/2004 Zhu et al. ..... 333/202
7,525,711 B1 * 4/2009 Rule et al. ..... 359/244

* cited by examiner

*Primary Examiner* — Ryan Johnson
(74) *Attorney, Agent, or Firm* — Gerhard W. Thielman, Esq.

(57) ABSTRACT

An optically tunable cavity for an electronic device concurrently achieves high bandwidth (for example, at least about 10 percent, typically greater than about 50 percent) with high DC-RF efficiency (for example, at least about 50 percent, typically greater than about 85 percent). The electronic device may be a vacuum electronic device, including linear-beam and cross-field devices, with either an input circuit or an output circuit, or both, containing a photocapacitance-controlled resonator embedded such that a laser beam can impinge upon a semiconductor gap of the resonator. The laser beam may instantaneously change the resonant mode of the overall loaded cavity, thus allowing for amplification or oscillation of the desired frequency throughout the vacuum electronic device.

20 Claims, 1 Drawing Sheet

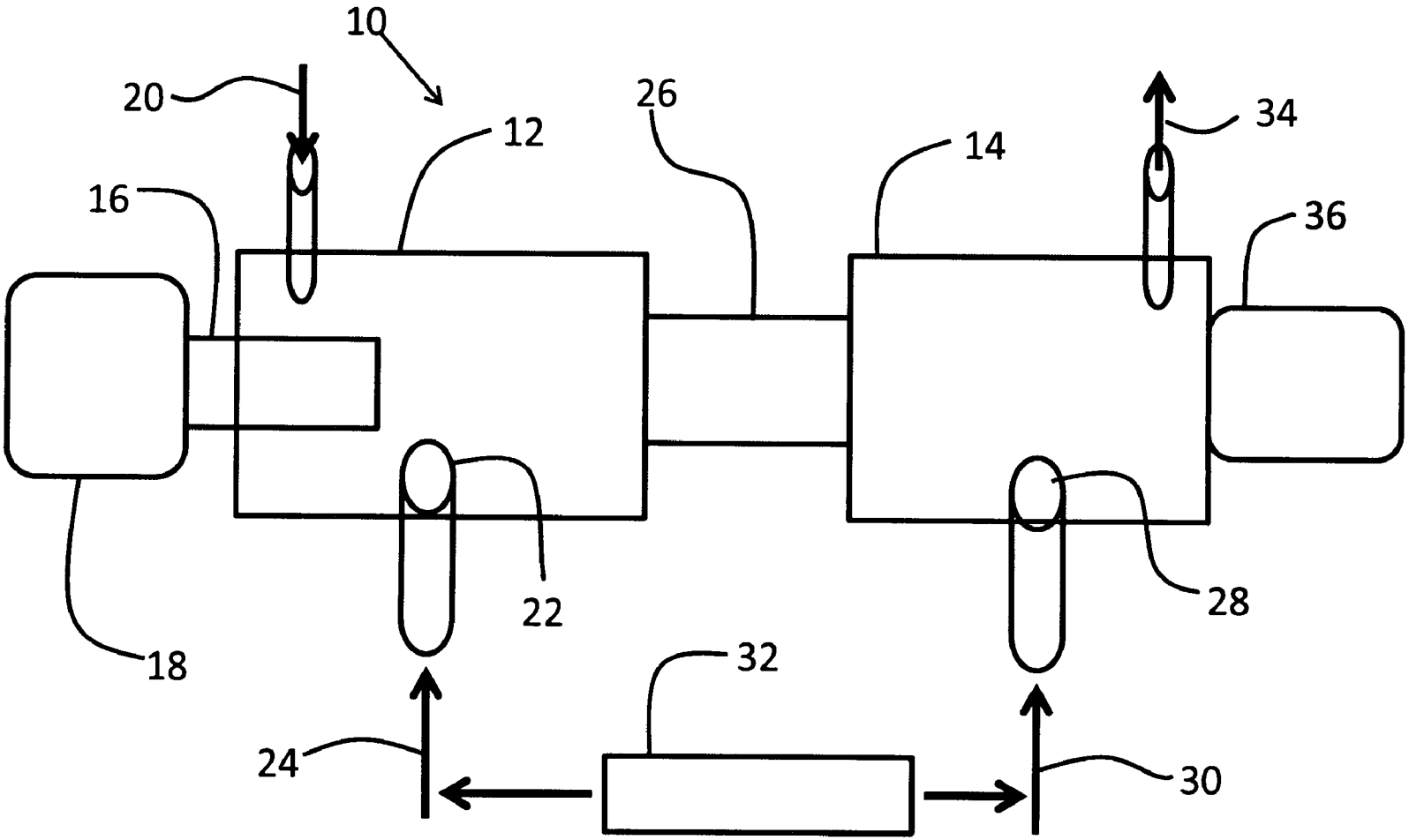
10
12
14
16
18
20
22
24
26
28
30
32
34
36

PHOTOCAPACITIVELY TUNABLE ELECTRONIC DEVICE UTILIZING ELECTRICAL RESONATOR WITH SEMICONDUCTOR JUNCTION

STATEMENT OF GOVERNMENT INTEREST

The invention described herein was made in the performance of official duties by one or more employees of the Department of the Navy, and the invention herein may be manufactured, practiced, used, and/or licensed by or for the Government of the United States of America without the payment of any royalties thereon or therefor.

BACKGROUND

The invention relates to resonant cavities and electronic devices and is directed more particularly to a design for an optically tunable cavity for an electronic device yielding high-Q operation and thus, constant high-efficiency bandwidth.

In a typical klystron, radio frequency (RF) signals are amplified by converting the kinetic energy in a direct current (DC) electron beam into radio frequency power. The beam of electrons is accelerated by high-voltage electrodes (the voltage being typically in the tens of kilovolts). This beam is then passed through an input cavity. RF energy is fed into the input cavity at, or near, the natural frequency of the cavity to produce a voltage which acts on the electron beam. The electric field causes the electrons in the beam to "bunch." Electrons that pass through the cavity during the period when the RF input energy creates an electric field opposing the electron in the beam are accelerated and later electrons are slowed, causing the previously continuous electron beam to form "bunches" at the input frequency. To reinforce the "bunching," a klystron may contain or consist of additional "buncher" cavities. The RF current now carried by the electron beam produces an RF magnetic field, and this may in turn excite a voltage across the gap of subsequent resonant cavities. In an output cavity, the developed RF energy is coupled out. The spent electron beam, with reduced energy, is captured in a collector. Tuning a conventional klystron with respect to a specified RF frequency may be a delicate procedure and may require several steps and considerable time.

Typically, vacuum electronic devices are narrowband by nature. In recent years, dual cavity klystrons have achieved about 8 percent experimental electronic bandwidth by utilizing a dual gap out filter scheme. The trade-off for this increase in bandwidth is loss of gain, and thus, efficiency. Including solid state amplifiers, to date, no known device of reasonable bandwidth (for example, greater than 10 percent) yields more than about 40 percent direct current-radio frequency (DC-RF) efficiency. Narrowband (less than 2 percent) devices exist with high efficiencies (greater than 88 percent), but such oscillators are inherently narrowband and thus cannot, with past and current techniques, be constructed to yield large bandwidths.

Piezoelectric devices have been used to variably tune resonant cavities. However, these devices require additional electrical inputs, outputs and may generate interference, requiring additional shielding. Some of these piezoelectric devices require other adaptive measures. For example, U.S. Pat. No. 4,737,738, issued to Perring, describes a resonant cavity having movable planar members where a piezoelectric crystal is attached to one of the movable planar members.

There is a need for an optically tunable cavity for a vacuum electronic device that achieves both high bandwidth and high efficiency.

SUMMARY OF THE INVENTION

According to one aspect of the current invention, a resonant cavity comprises a photocapacitively tuned resonator disposed in the resonant cavity, wherein an optical stimulation is adapted to impinge on the photocapacitively tuned resonator for instantaneously changing a resonant mode of the resonant cavity.

According to another aspect of the current invention, an electronic device comprises an input cavity including a photocapacitively tuned resonator disposed in the input cavity, wherein an optical stimulation is adapted to impinge on the photocapacitively tuned resonator for instantaneously changing a resonant mode of the input cavity.

According to a further aspect of the current invention, a vacuum electronic device comprises an input cavity including a first photocapacitively tuned resonator disposed in the input cavity, wherein a first optical stimulation is adapted to impinge on the photocapacitively tuned resonator for instantaneously changing a first resonant mode of the input cavity; an output cavity including a second photocapacitively tuned resonator disposed in the output cavity, wherein a second optical stimulation is adapted to impinge on the second photocapacitively tuned resonator for instantaneously changing a second resonant mode of the output cavity; and a drift space between the input cavity and the output cavity.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein:

The FIGURE shows a schematic drawing of a klystron-like device utilizing an optically tunable cavity according to an exemplary embodiment of the current invention.

DETAILED DESCRIPTION OF THE EXEMPLARY EMBODIMENTS

The following detailed description is of the best currently contemplated modes of carrying out exemplary embodiments of the invention. The description is not to be taken in a limiting sense, but is made merely for the purpose of illustrating the general principles of the invention: the scope of the invention is best defined by the appended claims.

Broadly, an embodiment of the current invention provides an optically tunable cavity for an electronic device. The device may concurrently achieve high bandwidth (for example, at least about 10 percent, typically greater than about 50 percent) and high DC-RF efficiency (for example, at least about 50 percent, typically greater than about 85 percent). The electronic device may, for example, comprise a vacuum device, including linear-beam and cross-field devices, with either an input circuit or an output circuit, or both, containing a photocapacitance-controlled resonator embedded such that a laser beam can impinge upon a semiconductor gap of the resonator.

The laser beam may instantaneously change the resonant mode of the overall loaded cavity, thus allowing for amplification or oscillation of the desired frequency throughout the vacuum electronic device. The resonant mode of the overall loaded cavity can be tuned at the speed that the optical intensity of the laser beam can be varied. As a result, high-rate variation in the tuning helps to control and improve efficiency, gain, and band-width. As used herein, the term "instantaneously" refers to the time that the optical intensity of the laser beam impinging on the resonator can be varied. Typically, "instantaneously" refers to a rate less than about one nanosecond.

Referring now to the FIGURE, an electronic device 10 (also referred to as a vacuum electronic device 10) may include at least one cavity, such as an input cavity 12 or an output cavity 14. In some embodiments, the vacuum electronic device 10 may include both the input cavity 12 and the output cavity 14. The vacuum electronic device 10 of the FIGURE is a klystron-like device. In other embodiments, the vacuum electronic device 10 may be, for example, a linear-beam device, such as an inductive output tube (IOT) or a travelling wave tube (TWT); a cross-field device, such as a magnetron or a cross field amplifier (CFA); or a solid-state device, such as integrated amplifiers/oscillators.

An electron beam may be emitted from a high voltage source 18. The electron beam may be, for example, delivered from a single or multiple beam electron gun 16 that may or may not be gridded, depending on the desired application. Low power RF 20 may be injected into the input cavity 12. The low power RF injection may be, for example, capacitive or inductive.

A photocapacitively tuned resonator 22 may be disposed in the input cavity 12. The photocapacitively tuned resonator 22 may be a photo-tuned split ring resonator, as described in U.S. Pat. No. 7,525,711, issued to Rule et al., the disclosure of which is herein incorporated by reference. Optical stimulation 24, such as a laser beam, may be delivered to the photocapacitively tuned resonator 22. As described in Rule et al., a tunable electromagnetic metamaterial may include a substrate and an array of split ring resonators formed on the substrate. The substrate may be made from a circuit board material or from other suitable materials. At least one of the split ring resonators may be a capacitively tuned split ring resonator. The capacitively tuned split ring resonator may include a structure having a gap and may be formed of an electrically conductive material. The capacitively tuned split ring resonator may also include a region of photo-capacitive material formed in close proximity to the structure such that the capacitance of the metamaterial may be changed when illuminated by controlling electromagnetic radiation having a selected range of wavelengths. One example of such a photocapacitive material is semi-insulating (SI) GaAs. The metamaterial may be designed to have an effective magnetic permeability, $p_{eff}$, which may be actively tuned, switched, and/or modulated in the vicinity of a particular frequency band of subject electromagnetic radiation.

In the klystron-like vacuum electronic device 10 shown in the FIGURE, a drift space, such as a drift tube 26, or multiple cavity resonators, may connect the input cavity 12 with the output cavity 14. The output cavity 14 may include a second photocapacitively tuned resonator 28, which may be designed similar to the photocapacitively tuned resonator 22 disposed in the input cavity 12. Optical stimulation 30, such as a laser beam, may be delivered to the second photocapacitively tuned resonator 28.

An electronic phase/frequency locking feedback device 32 may control the optical stimulations 24, 30 to provide a high power RF extraction 34 of the proper phase, frequency, gain, power, bandwidth, or the like.

A beam dump 36 (also referred to as a collector) may be disposed at the output cavity 14. The beam dump 36 may destroy the electron beam after the RF energy has been extracted therefrom. In some embodiments, a depressed beam dump may be used to recover energy from the electron beam before collecting electrons. Multistage depressed collectors may enhance energy recovery by sorting the electrons into energy bins.

The above described vacuum electronic device 10 may permit optical tuning of resonators 22, 28 disposed in input cavities 12 and/or output cavities 14. The vacuum electronic device 10 may have high RF-DC efficiency, typically greater than 50 percent, often greater than 85 percent. At the same time, the vacuum electronic device 10 may have high bandwidth, typically greater than 10 percent, often greater than 50 percent.

For linear-beam devices, fundamental mode operation should guarantee proper operation and may allow for large bandwidths to be achieved. Higher order modes may be utilized as well. In some embodiments, the vacuum electronic device 10 may have a tunability of the photocapacitively tuned split ring resonator of about 175% of its fractional bandwidth. Expectation of loaded cavity tunability may be on the order of 50 percent or greater. Maintaining high-Q operation inside the cavity may be desirable for maintaining high efficiency throughout the band of operation.

In one example of a vacuum electronic device, a class-F operation of an inductive output tube (IOT), with photo-tunable input and output cavities, may well yield a vacuum electronic device operation space of greater than 50 percent effective instantaneous bandwidth, concomitant with a DC-RF efficiency greater than 85 percent and relative constant across the fraction bandwidth.

The concepts described above may find use in tunable electronic devices involving semiconductors and the like, such as any oscillator/amplifier paradigm involving an RF/optical system with gain.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A resonant cavity comprising:

a photocapacitively tuned resonator disposed in the resonant cavity, wherein an optical stimulation is adapted to impinge on the photocapacitively tuned resonator for instantaneously changing a resonant mode of the resonant cavity.

2. The resonant cavity of claim 1, wherein the photocapacitively tuned resonator is a split ring resonator.

3. The resonant cavity of claim 2, wherein the split ring resonator is part of a tunable electromagnetic metamaterial.

4. The resonant cavity of claim 3, wherein the tunable electromagnetic metamaterial comprises a substrate and an array of split ring resonators formed on the substrate, wherein at least one of the split ring resonators comprises a capacitively tuned split ring resonator, the capacitively tuned split ring resonator including a structure having a gap and formed of an electrically conductive material and a region of photo-capacitive material formed in close proximity to the structure, wherein the photo-capacitive material comprises semi-insulating GaAs.

5. The resonant cavity of claim 1, further comprising an electron gun adapted to deliver electrons to the resonant cavity.

6. The resonant cavity of claim 1, further comprising a low power radio frequency injection adapted to deliver a radio frequency signal into the resonant cavity.

7. An electronic device comprising:

an input cavity including a photocapacitively tuned resonator disposed in the input cavity, wherein an optical stimulation is adapted to impinge on the photocapacitively tuned resonator for instantaneously changing a resonant mode of the input cavity.

8. The electronic device of claim 7, further comprising an output cavity including a second photocapacitively tuned resonator disposed in the output cavity, wherein a second optical stimulation is adapted to impinge on the second photocapacitively tuned resonator for instantaneously changing a resonant mode of the output cavity.

9. The electronic device of claim 8, further comprising a drift space between the input cavity and the output cavity.

10. The electronic device of claim 9, wherein the drift space includes drift tubes.

11. The electronic device of claim 8, further comprising a high power radio frequency extraction adapted to extract a radio frequency signal from the output cavity.

12. The electronic device of claim 8, further comprising a beam dump electrically connected to the output cavity.

13. The electronic device of claim 7, further comprising an electronic phase/frequency locking device adapted to control the optical stimulation.

14. The electronic device of claim 8, further comprising an electronic phase/frequency locking device adapted to control the optical stimulation and the second optical stimulation.

15. The electronic device of claim 7, further comprising an electron gun adapted to deliver electrons to the resonant cavity.

16. The electronic device of claim 7, wherein the photocapacitively tuned resonator is a split ring resonator.

17. The electronic device of claim 16, wherein the split ring resonator is part of a tunable electromagnet metamaterial.

18. A vacuum electronic device comprising:

an input cavity including a first photocapacitively tuned resonator disposed in the input cavity, wherein a first optical stimulation is adapted to impinge on the photocapacitively tuned resonator for instantaneously changing a first resonant mode of the input cavity;

an output cavity including a second photocapacitively tuned resonator disposed in the output cavity, wherein a second optical stimulation is adapted to impinge on the second photocapacitively tuned resonator for instantaneously changing a second resonant mode of the output cavity; and a drift space between the input cavity and the output cavity.

19. The vacuum electronic device of claim 18, further comprising:

an electron gun adapted to deliver electrons to the input cavity; and a beam dump adapted to absorb electrons after radio frequency power is extracted therefrom.

20. The vacuum electronic device of claim 19, further comprising an electronic phase/frequency locking device adapted to control the first optical stimulation and the second optical stimulation.

* * * * *